United States Patent [19]

Schirmacher

[11] Patent Number: 4,915,145

[45] Date of Patent: Apr. 10, 1990

[54] MONITORING SYSTEM FOR THE FILLING OF CONTAINERS

[75] Inventor: Manfred Schirmacher, Bergkamen, Fed. Rep. of Germany

[73] Assignee: Schering Aktiengesellschaft, Bergkamen, Fed. Rep. of Germany

[21] Appl. No.: 294,764

[22] Filed: Jan. 6, 1989

[30] Foreign Application Priority Data

Mar. 3, 1988 [DE] Fed. Rep. of Germany ..... 3806899

[51] Int. Cl.[4] ..... B65B 1/30; B67D 5/00

[52] U.S. Cl. ..... 141/95; 141/192; 141/198; 141/83; 73/290 R; 73/304 R; 340/620

[58] Field of Search ..... 141/1, 83, 94, 95, 96, 141/192, 198; 73/304 R, 304 C, 290 R; 340/620

[56] References Cited

U.S. PATENT DOCUMENTS

| | | | |
|---|---|---|---|
| 2,824,278 | 2/1958 | Johnston | 340/620 X |
| 3,328,789 | 6/1967 | Pacheco | 340/620 X |
| 3,477,460 | 11/1969 | Dotto | 340/620 X |
| 3,540,027 | 11/1970 | Rauth et al. | 340/620 |
| 3,863,147 | 1/1975 | Erath | 73/304 C X |
| 3,905,243 | 9/1975 | Goldfuss | 73/295 |
| 4,449,405 | 5/1984 | Franz et al. | 73/304 C |
| 4,480,251 | 10/1984 | McNaughton et al. | 340/620 X |
| 4,530,384 | 7/1985 | Boyes | 141/95 |
| 4,567,762 | 2/1986 | Hoppert et al. | 73/304 R |
| 4,593,275 | 6/1986 | Kazandjoglou | 340/620 X |

*Primary Examiner*—Ernest G. Cusick

*Attorney, Agent, or Firm*—Scully, Scott, Murphy & Presser

[57] ABSTRACT

A monitoring system for the filling of containers from a tank station, which is secured with a shut-off device, with the cooperation of at least one connecting line possessing a preferably electrical measuring device which determines the maximum permissible level of the product.

5 Claims, 1 Drawing Sheet

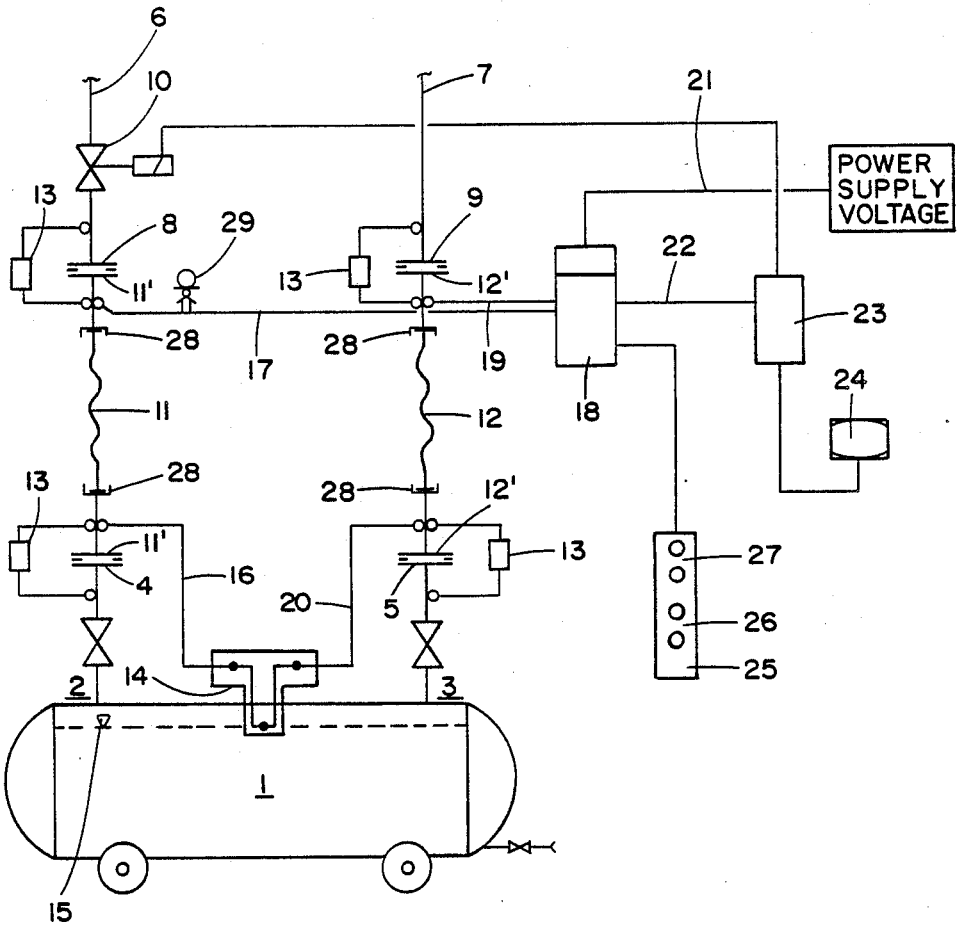
POWER SUPPLY VOLTAGE
6
7
10
21
13
8
29
9
22
11'
13
12'
23
28
17
28
19
24
11
12
18
13
28
28
12'
11'
13
27
4
16
20
5
26
25
2
14
3
1
15

MONITORING SYSTEM FOR THE FILLING OF CONTAINERS

BACKGROUND OF THE INVENTION

1. Field of the Invention

The present invention relates to a monitoring system for the filling of containers from a tank station which is secured with the intermediary of a shut-off device, with the cooperation of at least one connecting line possessing a measuring device, which is preferably electrical, and which determines the maximum permissible level of the product.

The handling of liquids of the type which endanger the environment, especially during the filling of transportable vessels; for example, such as tank trucks, necessitates the observance of special safety precautions in dependence upon the particular properties of the liquid. On the one hand, this relates to the dependability of the interconnections which are existent between the stationary pipeline connections or terminals which serve for the filling and, on the other hand, to that of the vessel as well as the filling procedure itself; especially the monitoring of the adherence to a maximum filling condition within the container.

2. Discussion of the Prior Art

The heretofore known systems; in essence, such as scales, counters, dispensing nozzles or the like, are in numerous instances considered as not being adequately dependable in operation, among other reasons this being their susceptibility to accumulations of dirt; and moreover, concern themselves only with partial aspects of the above-mentioned problem. This limitation also pertains to currently known safety devices which are employed to guard against overfilling.

With respect to the kinds of liquids which are to be handled herein; for example, this may relate to water-contaminating, combustible liquid mixtures, acids, solvents or the like which, in individual cases, carry along problems of corrosion, as a result of which there will be influenced over the course of time the reliability of a connection which exists between a tank station and a tank vehicle. The observance of all of these safety precautions, moreover, represents an additional obstruction to the enablement of such types of tank stations to be integrated into automatically operating installations.

SUMMARY OF THE INVENTION

Accordingly, it is an object of the present invention to develop a monitoring system which is adapted for the filling of containers, by means of which it is possible to provide an automated monitoring of the essential safety aspects of the filling procedure, and through which any detected malfunctions which endanger the safety of operation will immediately allow for the termination of a current filling procedure; or in effect, prevent the commencement of a filling procedure.

This particular object of the invention is solved by a monitoring system of the type as described hereinabove through the utilization of an electrically-conductive connecting line whose interconnection or juncture, on the one hand, with the container, and on the other hand, with the tank system, is constructed so as to be essentially electrically insulated; and through the use of an electrical circuit which serves for the monitoring of the filling procedure, into which circuit there are integrated the measuring device as well as the connecting line.

It is of importance to the invention that a safety precaution against overfilling; namely, a measuring device, which behaves as a threshold or limiting value indicator, is combined with an installation for monitoring the condition of the connecting line, such as to be able to immediately recognize, on the one hand, the presence of malfunctions in the region of the connecting line, and on the other hand, any possible overfilling of the container. For example, the signaling of such types of disruptions or malfunctions can be operatively linked with an instantaneous termination of the product flow. Moreover, the possibility is in existence of bringing, in a known manner, such types of malfunctions into display in a control room or on a control panel. The above-mentioned electrical circuit, into which there is integrated the measuring device as well as the connecting line, accordingly represents the element by means of which the monitoring is effectuated. In conjunction with the foregoing, it is of further importance that the electrically-conductive connecting line be connected electrically-insulated, on the one hand, with respect to the tank station, and on the other hand, with respect to the container, so that the electric current which is conducted through the connecting line is merely dependent upon the condition of this line; in essence, its interconnection or linkage with the insulated ends of the tank station and, respectively, with the similarly insulated connecting locations on the container.

Pursuant to further features of the invention, the measuring installation is constructed as a cold-line system which, in this instance, because of its robust construction, is viewed as being particularly advantageous. The system is especially shock-resistant in that merely two lines are required for its operation. The cold-line system reacts, as known, in response to the temperature of the environment and is employed herein as a threshold indicator. Any change in the impedance, which is caused by the reaching of a maximum filling condition, can thus be immediately recognized through the above-mentioned electrical circuit, and with the utilization of control technology, is converted into the termination of a further flow of product. Through the mentioned monitoring installation, a voltage source is made available in the electrical circuit, and moreover, there is monitored the electrical circuit; for example, with respect to its electrical conductivity. Consequently, during a continual filling procedure, as well as prior to the commencement of a filling procedure, it is possible to recognize the condition of the connecting line through the intermediary of the electrical circuit.

Further features of the invention contemplate measures for the avoidance of localized electrostatic charges.

BRIEF DESCRIPTION OF THE DRAWING

Reference may now be had to the following detailed description of a preferred embodiment of the invention, illustrating a generally diagrammatic monitoring system in the single FIGURE of accompanying drawing.

DETAILED DESCRIPTION

Reference numeral 1 designates, in the drawing, a transportable container for the receipt of liquids, which container is equipped at location 2 with a filling opening and at location 3 with a vent opening. The liquids which are received in the container 1; for example, can relate to water-contaminating substances, such as combustible liquid mixtures, acids, solvents and the like; in effect, liquids whose handling necessitates the implementation of special safety precautions.

The openings in the container which are arranged at locations 2, 3 are constructed so as to be closable, in a manner not illustrated in detail herein, and on the outside thereof are respectively equipped with connecting flanges 4, 5.

Reference numerals 6 and 7, respectively, identify stationarily located pipelines which serve, respectively, for the delivery of liquid and their venting, and whose end points are formed by connecting flanges 8, 9. Within the course of the pipeline 6 there is arranged; for example, an electromagnetically-actuatable shut-off element or valve 10.

By means of reference numerals 11, 12, there are designated connecting lines; for instance, flexible connecting hoses which at their ends each again respectively terminate in connecting flanges 11' and 12'. The connecting line 11 is connected, at one end, to the pipeline 6 through it connecting flange 11', and at the other end thereof to the connecting flange 4 of the container 1. A comparable interconnection is provided between the connecting flanges 12' of the connecting line 12, at one end thereof, with regard to the pipeline 7, and at the other end, with the connecting flange 5 of the container 1.

The connecting lines 11, 12, in a known manner, are constructed so as to be electrically conductive, whereby the flange connections which are constituted from the pairings of connecting flanges 8, 11'; 4, 11'; 5, 12' and 9, 12' are configured as electrically-insulating connections. This can be basically implemented in any suitable manner so as not to require any further detailed discussion thereof. Merely in order to avoid the formation of any electrostatic charges, are the above-mentioned insulated connections bridged over by impedances 13.

Identified by reference numeral 14 is a device which is adapted for the determination of the maximum permissible liquid level within the container 1; for example, the measuring sensor of which is formed by a known cold-line. The principle in the functioning of that type of cold-line system is predicated on that upon the immersion of the cold-conductor into the liquid, whose maximum permissible level is designated by reference numeral 15, there is encountered an impedance and resultingly a change in the current, from which information is derived that the maximum permissible level 15 has been reached. The installation 14, which is constructed so as to be intrinsically safe, is integrated into an electrical circuit which, commencing from the installation 14, is formed by a conductor element 16, the connecting line 11, a conductor element 17, a monitoring device 18, a conductor element 19, the connecting line 12 and a conductor element 20. By means of the conductor elements 16, 20, on the one hand, there is formed an electrical connection between the ends of the connecting lines 11, 12 which face towards the container 1, and on the other hand, with the device 14. Through the conductor elements 17, 19, on the one hand, there are formed electrical connections between the ends of the connecting lines 11, 12 which face towards the pipelines 6, 7, and on the other hand, with the monitoring device. Through the intermediary of the monitoring device 18, which is equipped with a connection 21 to a power supply as is shown in the drawing, this last-mentioned electrical circuit, which can be essentially contemplated as being a closed electrical circuit, has a defined voltage applied thereto, so as to generate a current which is dependent upon the temperature of the cold-line.

The monitoring device 18, the operation of which is described hereinbelow, whose constructional implementation is, however, basically of any suitable type, is in operative connection with a control device 23 through a line 22, whereby the shut-off element 10 can be actuated by the control device. The control device 23, moreover, can be equipped with an indicator unit 24 which displays the current switching condition of the shut-off element 10, or reports of malfunctions which are transmitted by means of the monitoring device 18. From a practical standpoint, the indicator unit 24 can be, for example, the monitor of an EDP (electronic data-processing) installation.

Finally, reference numeral 25 designates a control apparatus which is equipped with pushbuttons 26 and control lights 27, through which there can be initiated the procedure of the filling of the container 1, and also terminated. However, the procedure of the filling, which is conducted through the opening of the shut-off element 10, only takes place when diverse safety functions have been fulfilled to which, amongst others there belongs the filling condition of the container 1. Thus, a filling procedure cannot be initiated when there has been reached the maximum permissible level 15.

Hereinbelow, in summation, there is described the mode of operation of the above-described monitoring system:

As soon as the flange connections at both ends of the connecting lines 11, 12 are connected, at the one end, with the stationary pipelines 6, 7, and at other end, with respectively the filling openings and vent openings of the container 1, there is commenced the filling procedure through the control apparatus 25. A switching signal which is resultingly triggered is initially transmitted to the monitoring device 18, through which a defined voltage is applied to the above-mentioned electrical circuit, and there is tested the impedance of the cold-line. During this test, which is essentially based on a measurement of the impedance, in effect, the electrical conductivity, there is included the condition of the connecting hoses 11, 12, as well as that of the hose couplings which are identified in the drawing by reference numeral 28. This testing sequence takes place during a defined time interval, whereby a release signal is conducted to the control device 23 through electrical line 22 only when no malfunction has been determined as being in existence. By means of the control device 23 there is then opened the shut-off element 10.

The monitoring system remains activated during the entire filling procedure; in effect, as soon as the state of liquid in the container 1 has reached the permissible maximum level 15, the latter of which is determinable on the basis of the change in the impedance of the cold-conductor or line of the installation 14, then through intermediary of the monitoring device 18 there is actuated the control device 23 so as to close the shut-off element 10. Moreover, any current filling procedure is automatically terminated as soon as any kind of malfunction is encountered which results in a change in the electrical conductivity of the above-designated electrical circuit.

Reference numeral 29 designates an emergency shut-off switch which is integrated into the line element 17.

It can be readily ascertained that the above-illustrated monitoring system allows for an automatic filling of containers 1, and thereby the safe handling of the above-identified liquids, whereby there is provided a monitoring of the connecting lines, as well as any avoidance of exceeding a maximum permissible filling condition in the container.

The pipeline elements which carry the connecting flanges 11', 12' can be selectively considered as being a part of the pipelines 6, 7, in essence, that of the container 1, or also as a part of the connecting lines 11, 12.

What is claimed is:

1. A monitoring system for monitoring the filling of containers from a tank station; at least one fluid product connecting line for connecting the tank station to a container being filled with a fluid product through said at least one fluid product connecting line; a shut-off element for said at least one fluid product connecting line; an electrical measuring means in said at least one fluid product connecting line for determining the maximum permissible level of fluid product being filled into the container; said at least one connecting line being an electrically conductive connecting line connected through an electrically insulated connection at one end to the container, and connected through an electrically insulated connection at the opposite end to the tank station; and electrical monitoring circuit means for monitoring the electrical impedance of a series electrical circuit of said measuring means and said at least one fluid product connecting line, which characterizes the filling condition of the container and the condition of the connections between the tank station and the container.

2. A monitoring system as claimed in claim 1, wherein said measuring means comprises a cold-conductor system; and said monitoring circuit means includes at least one voltage source.

3. A monitoring system as claimed in claim 1, each electrically insulated connection including an impedance bridging over the electrically insulated connection for conducting off and dissipating electrostatic charges.

4. A monitoring system as claimed in claim 1, wherein said tank station further comprises a second fluid connecting line for venting exhaust gas from the container during filling of the container.

5. A monitoring system as claimed in claim 1, wherein a control device is coupled between said monitoring circuit means and said shut-off element, which is actuated by said control device in dependence upon the measured electrical impedance of said series electrical circuit.

* * * * *